US006484618B1

(12) United States Patent
Dubois

(10) Patent No.: US 6,484,618 B1
(45) Date of Patent: Nov. 26, 2002

(54) MARINE COUNTERMEASURES LAUNCH ASSEMBLY

(75) Inventor: Neil J. Dubois, Cranston, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/968,387

(22) Filed: Oct. 1, 2001

(51) Int. Cl.[7] ..... F41F 3/07

(52) U.S. Cl. ..... 89/1.11; 114/22; 89/1.809; 89/1.81

(58) Field of Search ..... 89/1.11, 1.809, 89/1.81; 102/402, 412; 114/22, 238; 367/1

(56) References Cited

U.S. PATENT DOCUMENTS 2,779,282 A * 1/1957 Raffel ..... 102/374
4,676,167 A * 6/1987 Huber et al. ..... 102/393
5,666,900 A * 9/1997 Carroll et al. ..... 114/238
6,336,641 B1 * 1/2002 Williams ..... 277/637
2002/0073831 A1 * 6/2002 MacLeon ..... 70/133

FOREIGN PATENT DOCUMENTS

GB 123598 * 3/1919 ..... 114/22

* cited by examiner

*Primary Examiner*—Michael J. Carone
*Assistant Examiner*—Gabriel S. Sukman
(74) *Attorney, Agent, or Firm*—Michael J. McGowan; Michael F. Oglo; James M. Kasischke

(57) ABSTRACT

A marine countermeasures launch assembly includes a cylindrical body including first and second members having, respectively, first and second surfaces engageable with each other to form the body, the first surface having first and second recesses therein, the second surface having first and second recesses therein opposed to the recesses of the first member when the members are engaged, to form a first chamber for retaining a first countermeasure and a second chamber for retaining a second countermeasure. The first and second surfaces have opposed bores therein. A spring is disposed in each pair of the opposed bores and urges the members to separate from each other to release the countermeasures after the assembly is launched.

7 Claims, 4 Drawing Sheets

MARINE COUNTERMEASURES LAUNCH ASSEMBLY

STATEMENT OF GOVERNMENT INTEREST

The invention described herein may be manufactured and used by and for the Government of the United States of America for Governmental purposes without the payment of any royalties thereon or therefor.

CROSS REFERENCE TO OTHER PATENT APPLICATIONS

Not applicable.

BACKGROUND OF THE INVENTION

1. Field of the Invention

The invention relates to the development of electronic countermeasures and is directed more particularly to an assembly for launching undersea warfare countermeasures which serve as decoys and to jam and confuse sonar systems of submarines and torpedoes.

2. Description of the Prior Art

Acoustic countermeasure devices have become an integral part of undersea warfare. Such devices are used to confuse hostile sonar systems and thereby protect own force assets. Typical countermeasures are launched from a submarine and transmit acoustic signals. The signals are transmitted at a selected depth in the ocean and the devices are maintained at the selected depth by an active compensation system which maintains buoyancy. In practice, the devices typically are slightly negatively buoyant, requiring means for providing upward force to maintain depth.

Referring to FIG. 1, it will be seen that a known prior art countermeasure assembly 10 includes a cylindrical tube 12 in which are disposed a buoyancy maintenance system and countermeasures electronics (not shown). Fixed to the tube 12 is a transducer 14 which transmits signals from the countermeasure assembly 10. A protective sabot 16 fits over the transducer 14 and is of a configuration which continues the cylindrical configuration of the tube 12.

Submarines are provided with launch tubes 20 having therein a ram plate 22, and a muzzle cap 26 disposed in a discharge end 28 of the tube 20 and held therein by shear pins 30. The launch tubes 20 typically are mounted outside the pressure hull of the submarine. The launch tube 20, ram plate 22, and muzzle cap 26 define a compartment 32 complementary in shape and size to the countermeasure assembly 10 and sabot 16.

Mounted in the tube 20 adjacent the ram plate 22 is a gas generator 34. From within the submarine the gas generator 34 is activated to release gas under pressure. The gas forces the ram plate forwardly, to the right as viewed in FIG. 1. The ram plate 22 and countermeasure 10, including the transducer 14 and sabot 16, move forwardly in the tube 12, shearing the muzzle cap shear pins 30 and blowing away the muzzle cap 26. The counter measure 10, transducer 14, and sabot 16 exit the tube 12, with the transducer 14 protected during transit by the sabot 16.

In due course, the sabot 16 drops away and the countermeasure 10, including the transducer 14, seeks a preselected depth from which to operate.

Recent advances in the buoyancy maintenance and transducer structure areas have resulted in reduced space requirements for countermeasures. It is now feasible from a size standpoint to launch two or more countermeasures from the prior art launch tube shown in FIG. 1.

SUMMARY OF THE INVENTION

Accordingly, an object of the invention is to provide a marine countermeasures launch assembly which facilitates the launch of a plurality of countermeasures from a single prior art launch tube.

With the above and other objects in view, as will hereinafter appear, a feature of the present invention is the provision of a marine countermeasures launch assembly comprising a cylindrical body comprising first and second members having, respectively, first and second surfaces engageable with each other to form the body. The first surface is provided with first and second recesses therein and the second surface is provided with first and second recesses opposed to the recesses of the first member when the members are engaged, to form a first chamber for retaining a first countermeasure and a second chamber for retaining a second countermeasure. The first and second surfaces have opposed bores therein. A spring is disposed in each pair of the opposed bores and urges the members to separate from each other to release the countermeasures after the assembly is launched.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 2:
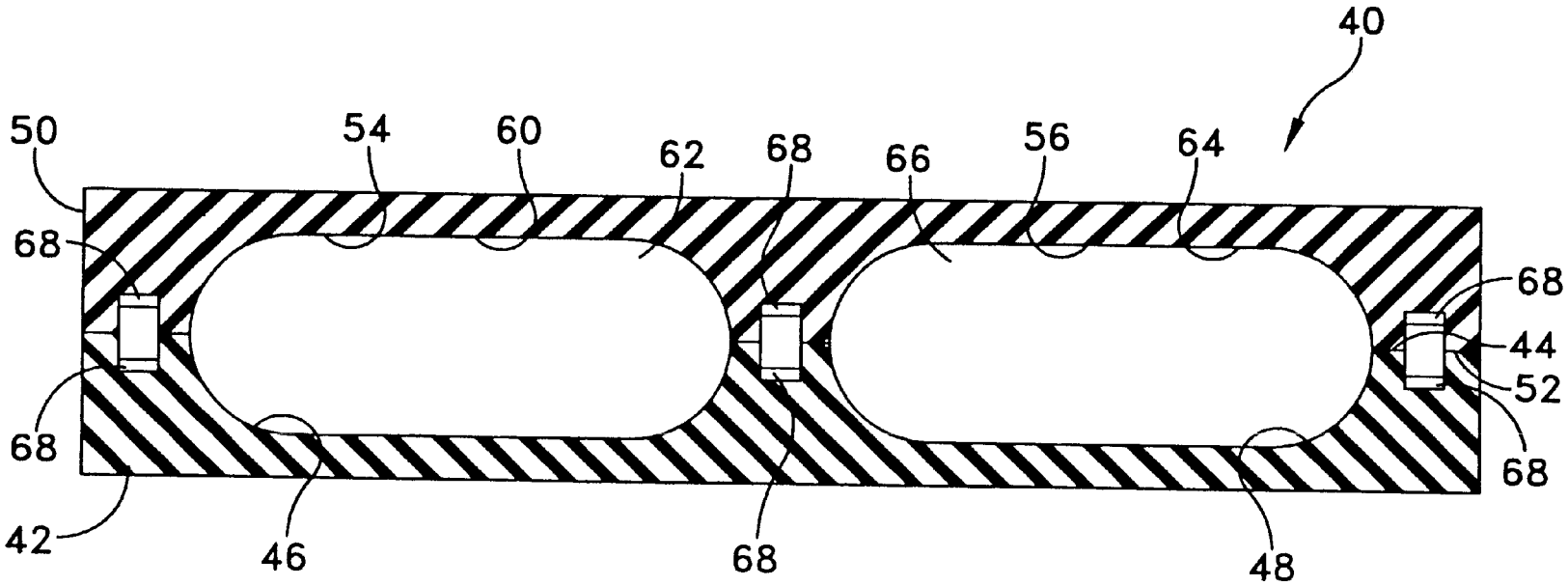
FIG. 2 is a diagrammatic, in part sectional view of one form of countermeasures launch assembly illustrative of an embodiment of the invention.
Figure 3:
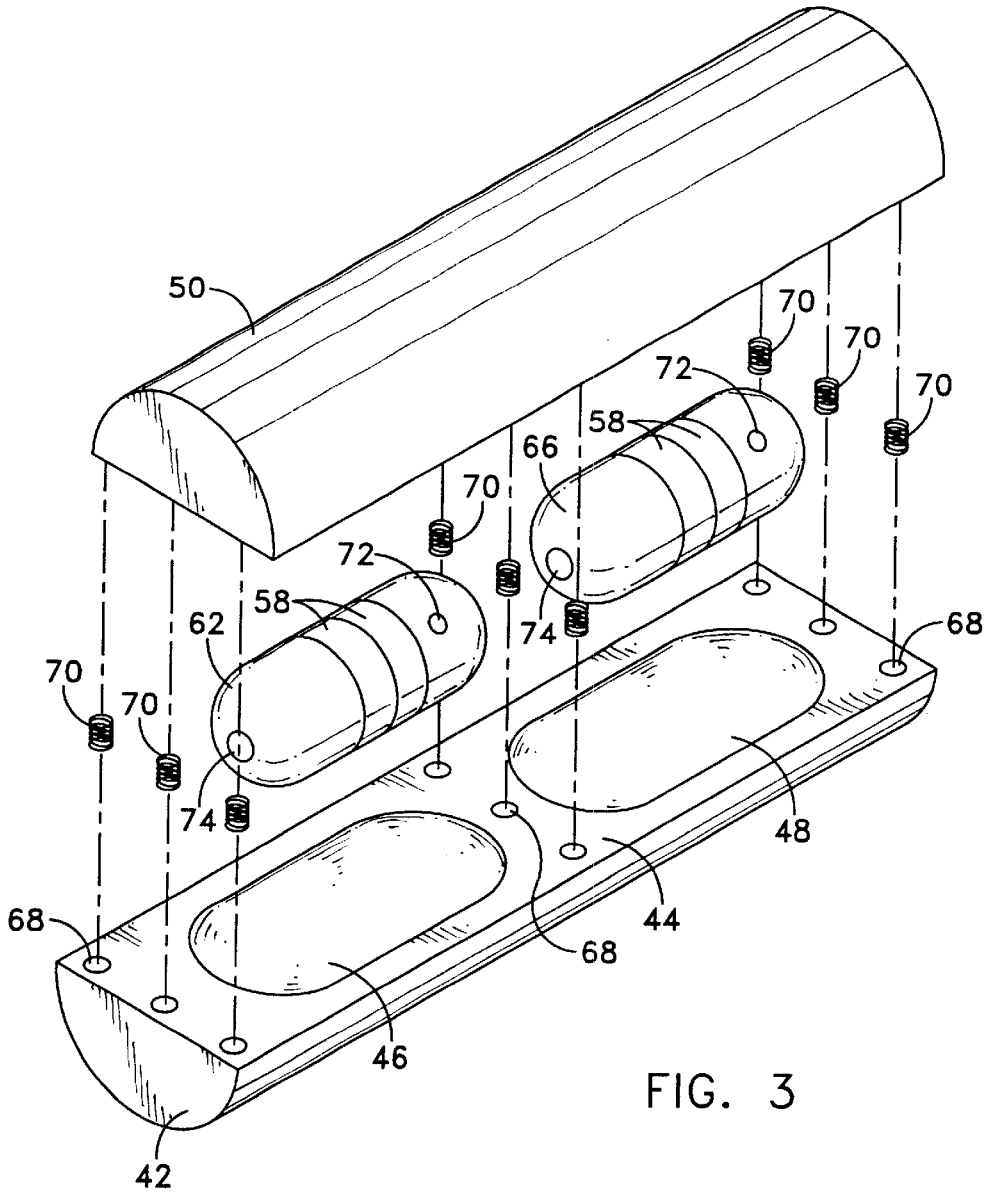
FIG. 3 is an exploded perspective view of the assembly of FIG. 2.
Figure 4:
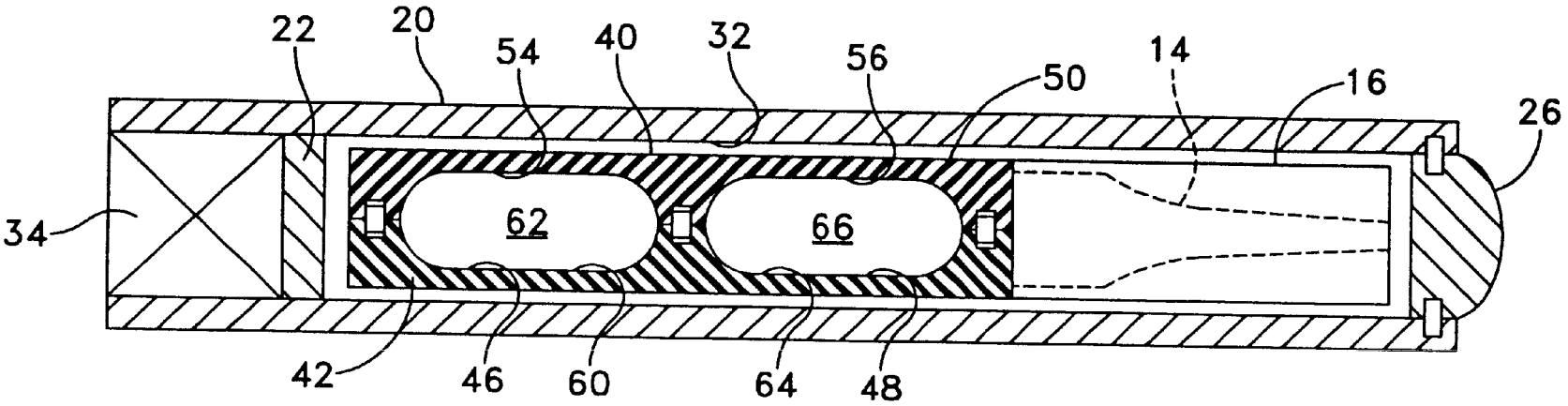
FIG. 4 is a diagrammatic in part sectional view of the assembly of FIGS. 2 and 3 disposed in the assembly of FIG. 1.

Referring to FIGS. 2–4, it will be seen that a preferred embodiment of the invention includes a cylindrical body 40 comprising a first member 42 having a first surface 44. First and second recesses 46, 48 are disposed in the surface 44. The cylindrical body 40 further comprises a second member 50 having a second surface 52 having first and second recesses 54, 56 therein. The recesses 46, 48 are opposed to the recesses 54, 56 when the members 42, 50 are engaged, as shown in FIG. 2, to form a first chamber 60 for retaining a first countermeasure 62, and a second chamber 64 for retaining a second countermeasure 66. The countermeasures 62, 66 each include transducers 58 in the body of the countermeasure.

The surfaces 44, 52 are complementary to each other so as to fully engage one another and, for ease of manufacture and interchangeability, preferably are planar. The surfaces 44, 52 are provided with opposed bores 68. A spring 70 is disposed in each pair of opposed bores 68. The springs 70 urge separation of the members 42, 50 to release the countermeasures 62, 66.

Figure 1:
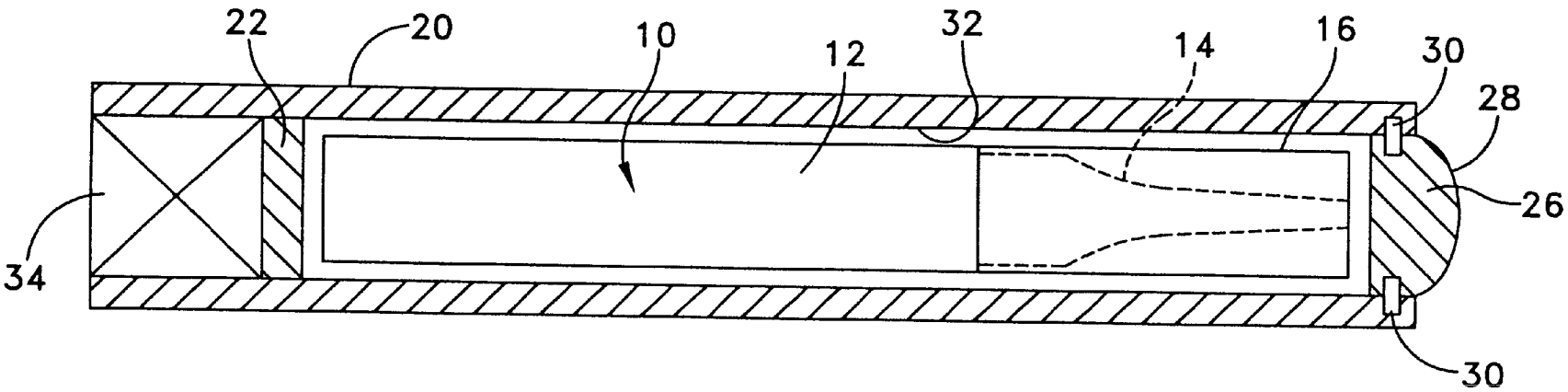
FIG. 1 (PRIOR ART)
FIG. 1 is a diagrammatic, in part sectional view of a prior art countermeasures launch assembly disposed in a launch tube.

In operation, the cylindrical body 40 is housed in the launch compartment 32 of the launch tube 20 (FIG. 4). The body 40 houses the countermeasures 62, 66. The body 40 is launched in the same manner as the countermeasure assembly 10, as described above with reference to FIG. 1. When the body 40 clears the launch tube 20, the springs 70 (FIG. 3) urge the members 42, 50 apart, releasing the countermeasures 62, 66. Each countermeasure is provided with its own pressure sensor 72 and depth regulator 74, and individually seeks its pre-selected depth and transmits signals, as previously programmed, by way of the transducers 58.

There is thus provided a marine countermeasures launch assembly which facilitates launch of a plurality of countermeasures from a single launch tube.

It will be understood that many additional changes in the details, materials, steps and arrangement of parts, which have been herein described and illustrated in order to explain the nature of the invention, may be made by those skilled in the art within the principles and scope of the invention as expressed in the appended claims. For example, it will be apparent that the maximum number of chambers defined by the cylindrical body depends upon the size of the countermeasures to be contained. While two chambers are shown for illustrative purposes, the invention contemplates additional chambers.

What is claimed is:

1. A marine countermeasures launch assembly comprising:

a cylindrical body comprising first and second members having, respectively, first and second surfaces engageable with each other to form said body, the first surface having first and second recesses therein, the second surface having first and second recesses therein opposed to the recesses of said first member when said members are engaged, to form a first chamber for retaining a first countermeasure and a second chamber for retaining a second countermeasure, the first and second surfaces having opposed bores therein; and a spring disposed in each pair of the opposed bores and urging said members to separate from each other to release the countermeasures after the assembly is launched.

2. The assembly in accordance with claim 1 wherein the first and second surfaces are planar surfaces.

3. The assembly in accordance with claim 1 wherein said springs are coil springs.

4. A countermeasures assembly comprising:

a launch tube having a compartment therein;

a cylindrical countermeasures body for disposition in said launch tube, said body comprising first and second members having, respectively, first and second surfaces engageable with each other to form said body, the first surface having first and second recesses therein, the second surface having first and second recesses therein opposed to the recesses of said first member when said members are engaged, to form a first chamber for retaining a first countermeasure and a second chamber for retaining a second countermeasure, the first and second surfaces having opposed bores therein, and a spring disposed in each pair of the opposed bores and urging said members to separate from each other to release the countermeasures after the assembly is launched; and a gas generator disposed in said launch tube and adapted to provide sufficient gas pressure in said tube to blow said cylindrical countermeasures body out of said tube.

5. The assembly in accordance with claim 4 wherein the first and second surfaces of the first and second members are planar surfaces.

6. The assembly in accordance with claim 4 wherein said springs are coil springs.

7. The assembly in accordance with claim 4 and further comprising:

a ram plate disposed in said tube;

a muzzle cap disposed in said tube; and said tube, ram plate and muzzle cap defining the compartment; and wherein the sufficient gas pressure is operable to move said ram plate to push said countermeasures body from said launch tube.

* * * * *